US008651728B2

(12) United States Patent
Tsai

(10) Patent No.: US 8,651,728 B2
(45) Date of Patent: Feb. 18, 2014

(54) LIGHTING MASTER AND LIGHTING DEVICE

(75) Inventor: Wen-Kuei Tsai, Taipei (TW)

(73) Assignee: Chang Wah Electromaterials, Inc., Kaohsiung (TW)

( * ) Notice: Subject to any disclaimer, the term of this patent is extended or adjusted under 35 U.S.C. 154(b) by 244 days.

(21) Appl. No.: 13/235,233

(22) Filed: Sep. 16, 2011

(65) Prior Publication Data

US 2012/0069601 A1 Mar. 22, 2012

(30) Foreign Application Priority Data

Sep. 16, 2010 (TW) ..... 99217932 A

(51) Int. Cl.
*F21V 29/00* (2006.01)
*H01R 33/00* (2006.01)
*F21V 15/01* (2006.01)

(52) U.S. Cl.
USPC ..... 362/645; 362/294; 362/311.02; 362/362; 362/373

(58) Field of Classification Search
USPC ..... 362/645, 362, 373, 294, 311.02
See application file for complete search history.

(56) References Cited

U.S. PATENT DOCUMENTS

| | | | | |
|---|---|---|---|---|
| 7,628,513 | B2 * | 12/2009 | Chiu | 362/311.02 |
| 7,677,767 | B2 * | 3/2010 | Chyn | 362/294 |
| 8,210,735 | B2 * | 7/2012 | Choi | 362/650 |
| 8,317,372 | B2 * | 11/2012 | Fu et al. | 362/373 |
| 8,334,641 | B2 * | 12/2012 | Tsai | 313/46 |
| 8,444,299 | B2 * | 5/2013 | Chou et al. | 362/294 |

* cited by examiner

*Primary Examiner* — Stephen F Husar
*Assistant Examiner* — James Cranson, Jr.
(74) *Attorney, Agent, or Firm* — Stout, Uxa, Buyan & Mullins, LLP

(57) ABSTRACT

The present invention is directed to a lighting master, which includes a base and a lighting module. A region defined between the base and a housing accommodates a power module. The lighting module is disposed over the base. The base has an outer surface to be bonded with an inner surface of the housing.

13 Claims, 7 Drawing Sheets

LIGHTING MASTER AND LIGHTING DEVICE

CROSS-REFERENCE TO RELATED APPLICATIONS

The entire contents of Taiwan Patent Application No. 099217932, filed on Sep. 16, 2010, from which this application claims priority, are incorporated herein by reference.

BACKGROUND OF THE INVENTION

1. Field of the Invention

The present invention generally relates to a lighting device, and more particularly to a lighting master that is capable of being matched with various housings.

2. Description of Related Art

Due to various advantages of a light-emitting diode (LED) such as small volume, short response time, low power consumption, high reliability and high feasibility of mass production, the LED is replacing conventional lighting devices such as light bulbs or fluorescent lamps.

However, the specifications of LED lamps and housing styles from a variety of manufacturers are oftentimes different from each other. It is therefore difficult to construct the LED lamps in modular parts, and the non-modular LED lamps are wastefully accumulated in warehouses. Moreover, when the LED lamp specification, or its housing style changes, it is difficult or impossible to reuse constructing parts of the LED lamp by disintegrating the LED lamp.

Accordingly, a need has arisen to propose a modular architecture of LED devices such that the LEDs, the housings and other constructing parts can be matched in use, therefore reducing accumulation in warehouses and improving effective usage.

SUMMARY OF THE INVENTION

In view of the foregoing, it is an object of the embodiment of the present invention to provide a lighting master that is capable of being matched with various housings to form a variety of lighting devices.

According to one embodiment, a lighting master includes a base and a lighting module. The base and a housing define a space to accommodate a power module. The lighting module is disposed over the base. The base has an outer surface to be bonded with an inner surface of the housing.

According to another embodiment, a lighting device includes a housing, a power module and a lighting master. The lighting master includes a base and a lighting module disposed over the base. The base and the housing define a space to accommodate the power module. The base has an outer surface to be bonded with an inner surface of the housing.

DETAILED DESCRIPTION OF THE INVENTION

Figure 1:
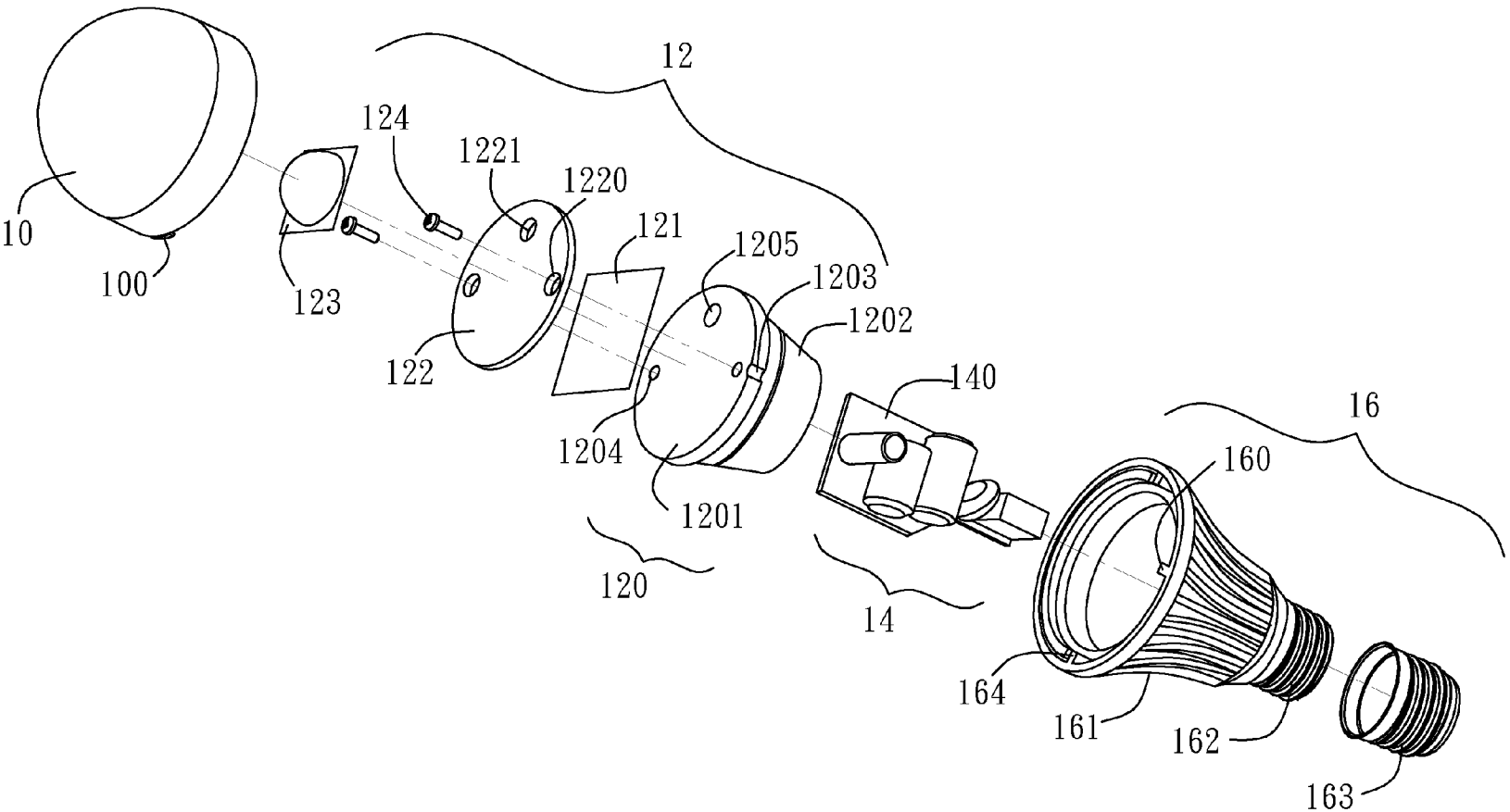
FIG. 1 shows an exploded view of a lighting device according to a first embodiment of the present invention.

FIG. 1 shows an exploded view of a lighting device according to a first embodiment of the present invention. Although a light-emitting diode (LED) is demonstrated, the present invention may be adapted to other lighting elements such as an organic light-emitting diode (OLED).

The lighting device primarily includes a lamp cover 10, a lighting master 12, a power module 14 and a housing 16. In the embodiment, the lighting master (or a light engine) 12 includes a base 120, a heat conductive sheet 121, a heat conductive substrate 122 and a lighting module 123. Specifically, the base 120 includes a plate 1201 and a hollow cylinder 1202 extended from a surface of the plate 1201. The plate 1201 and the hollow cylinder 1202 may be manufactured integrally, or may be individually made and then combined. The base 120 may be made of metal (such as copper or silver), ceramic or other heat conductive materials.

Figure 2:
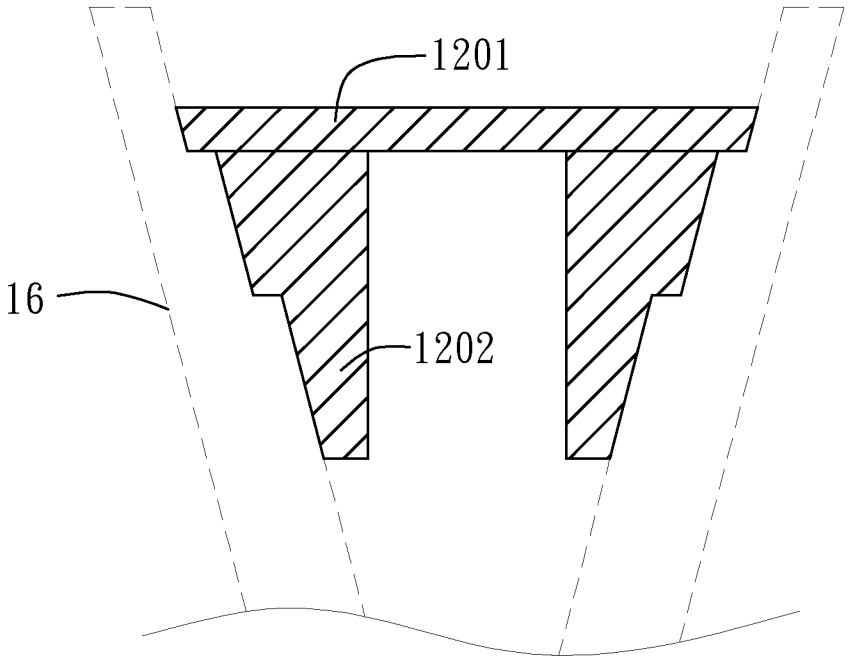
FIG. 2 shows a cross-sectional view of the base of FIG. 1.

FIG. 2 shows a cross-sectional view of the base 120. Specifically, the hollow cylinder 1202 has an inclined outer surface. The outer surface of the hollow cylinder 1202 may further have one or more steps, and a junction between the plate 1201 and the hollow cylinder 1202 may also form a step. These steps are used to bond with corresponding reverse steps on an inner surface of the housing 16. In a modified embodiment, the outer surface of the hollow cylinder 1202 may have screw thread (not shown), which is used to bond with corresponding reverse screw thread on the inner surface of the housing 16. Further, a side surface of the plate 1201 may have one or more notches 1203, which are used to fasten to corresponding hooks 160 of the housing 16. The space defined between the hollow cylinder 1202 and the housing 16 is used to accommodate the power module 14 or other elements such as a heat dissipating fan (not shown). In the embodiment, the surface of a printed circuit board (PCB) 140 of the power module 14 is perpendicular to the plate 1201 of the base 120.

The heat conductive substrate 122 may be made of metal (such as copper or silver), ceramic or other heat conductive materials. The lighting module 123 such as an LED module is attached, for example, by soldering, to a surface the heat conductive substrate 122 whose surface faces towards the lamp cover 10 (or backwards the housing 16). The heat conductive sheet 121 is disposed between the heat conductive substrate 122 and the base 120. The heat conductive substrate 122 may be screwed to the base 120 with screws 124 through threaded holes 1220 of the heat conductive substrate 122 and threaded holes 1204 of the plate 1201. The power/signal lines of the power module 14 may be connected to the lighting module 123 via a line outgoing hole 1205 of the plate 1201 and a line outgoing hole 1221 of the heat conductive substrate 122.

In the embodiment, the housing 16 includes a bottom housing 161, a top housing 162 and a lamp head 163 covering the top housing 162. Specifically, the top housing 162 is adjacent to the bottom housing 161, and the lamp head 163 may be screwed into a lamp socket (not shown) in order to transfer power provided by the lamp socket to an input node of the power module 14. The housing 16 may have a shape similar to that of a conventional light bulb or have other shapes. Heat dissipating fins may be formed on a surface of the bottom housing 161. The constructing parts of the housing 16 may be manufactured integrally, or may be individually made and then combined. The housing 16 may be made of plastic, metal, ceramic or other heat conductive materials. The lamp cover 10 is an optional part that may, for example, use one or more inner hooks 100 or other fastening means, to fasten to corresponding projecting points 164 of the housing 16.

According to the present embodiment, the constructing parts of the lighting master 12 are assembled and tested to build a half-finished product, which may be later matched with other parts (such as the lamp cover 10, the power module 14 or the housing 16) to form various lighting devices according to different designs. Accordingly, the accumulation in the warehouse may be substantially reduced.

Figure 3:
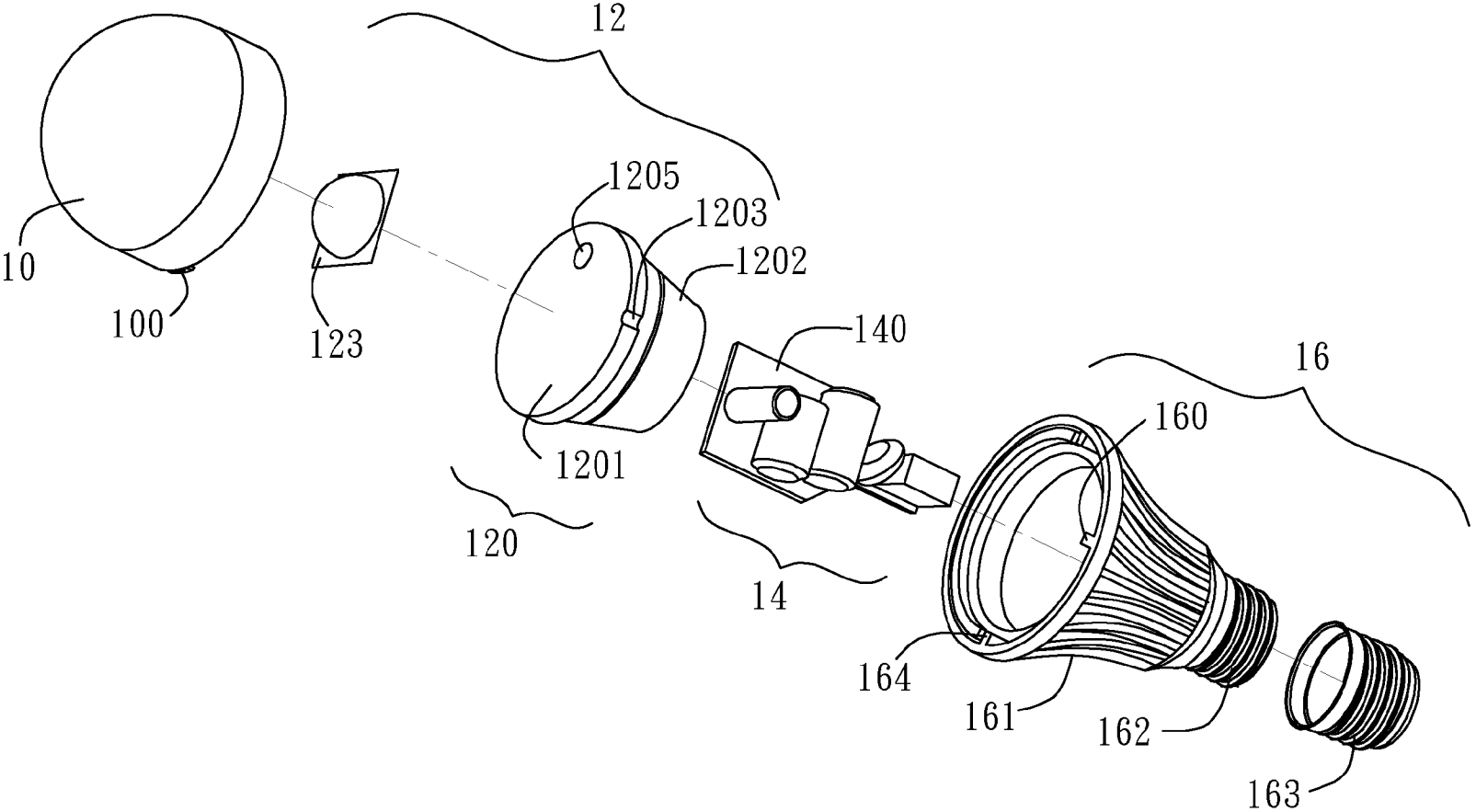
FIG. 3 shows an exploded view of a lighting device according to a second embodiment of the present invention.
Figure 4:
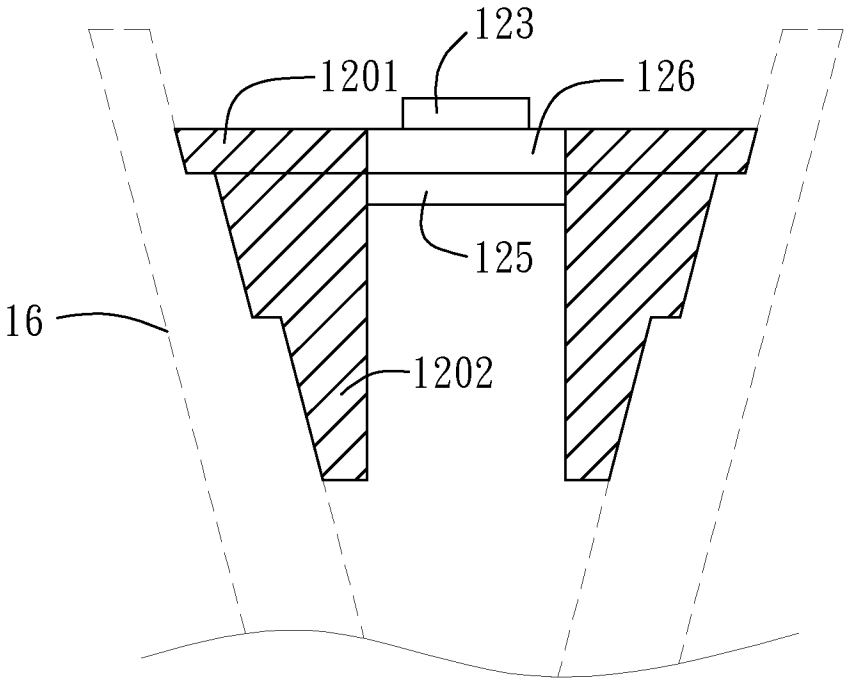
FIG. 4 shows a cross-sectional view of the base of FIG. 3.

FIG. 3 shows an exploded view of a lighting device according to a second embodiment of the present invention. The present embodiment FIG. 3) is similar to the first embodiment (FIG. 1) with the distinction that the lighting module 123 of the present embodiment is directly attached, for example, by soldering, onto the plate 1201 whose surface faces towards the lamp cover 10 (or backwards the housing 16), therefore omitting the heat conductive sheet 121 and the heat conductive substrate 122, and leaving the threaded hole 1204 out of the plate 1201. In a modified embodiment, as shown in FIG. 4, a printed circuit board 126 with a lighting module 123 and a control circuit 125 may be embedded in a hollow of the plate 1201. Some electronic elements may be mounted on the control circuit 125. Further, the control circuit 125 may be replaced with the printed circuit board 140 of the power module 14. In the embodiment, the lighting module 123 is disposed on the printed circuit board 126 whose surface faces towards the lamp cover 10 (or backwards the housing 16), and the control circuit 125 is disposed on the printed circuit board 126 whose surface faces towards the housing 16.

Figure 5A:
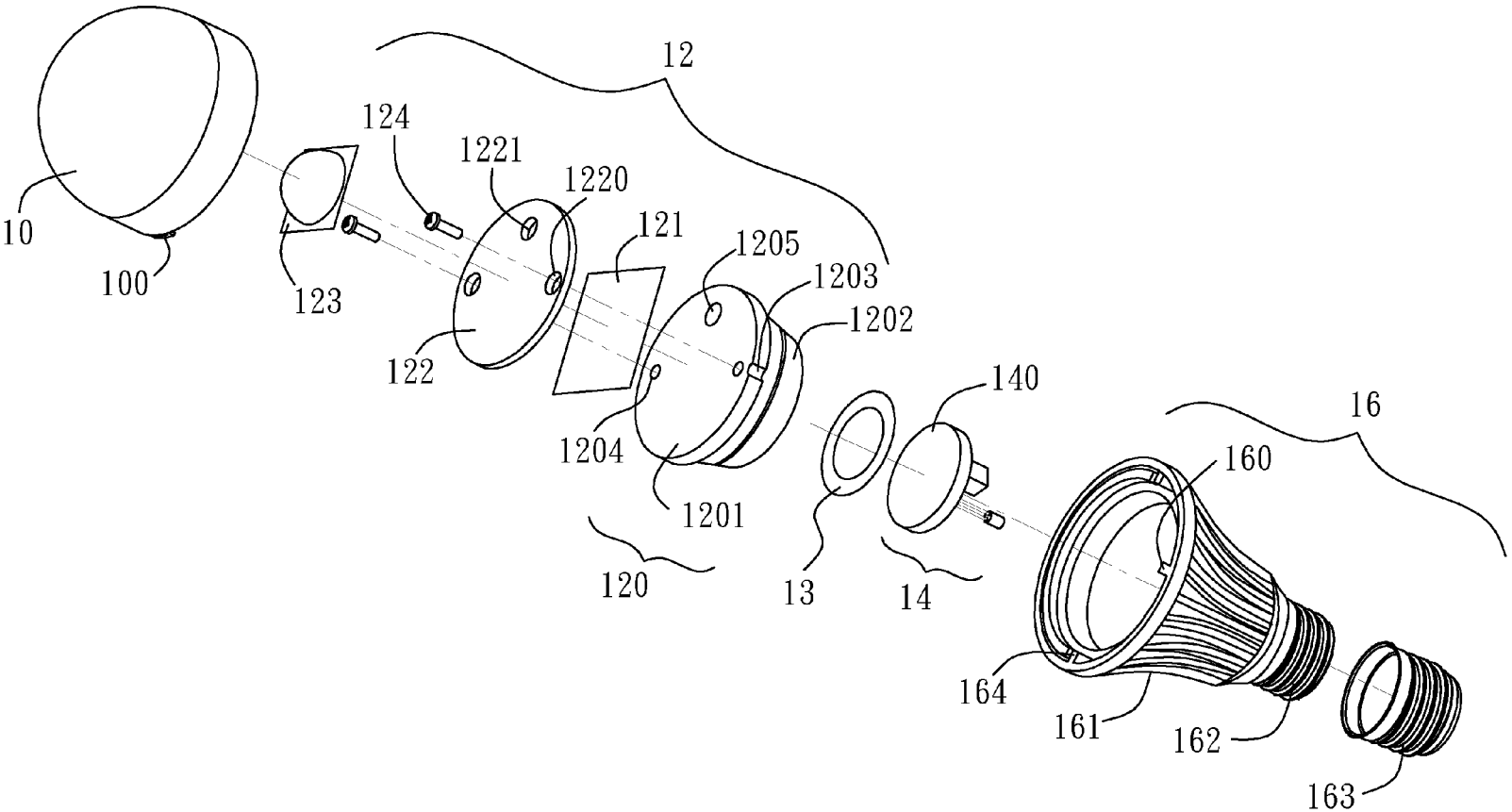
FIG. 5A shows an exploded, view of a lighting device according to a third embodiment of the present invention.
Figure 5B:
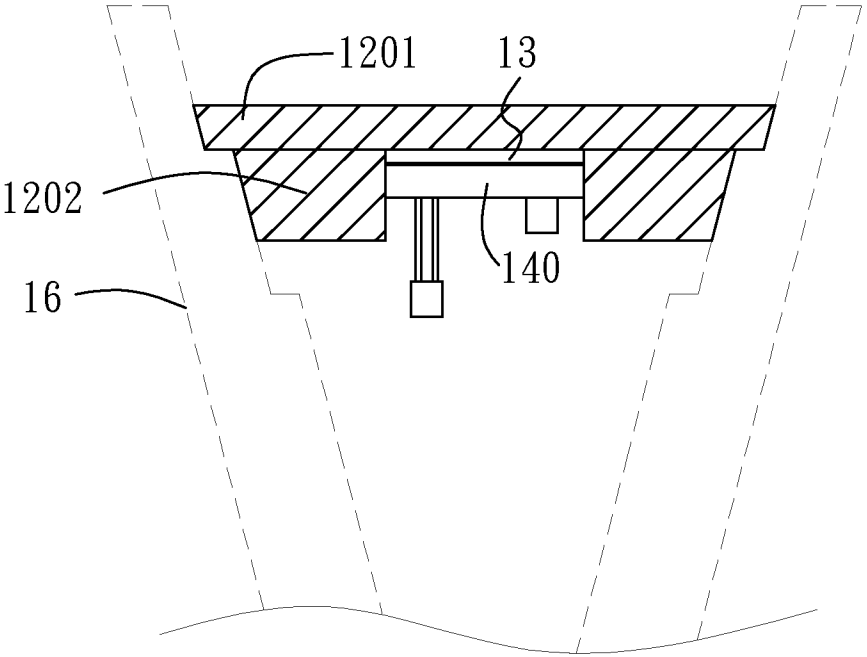
FIG. 5B shows a cross-sectional view of the hollow cylinder with the hollow annular insulation sheet and the printed circuit board of FIG. 5A.

FIG. 5A shows an exploded view of a lighting device according to a third embodiment of the present invention. The present embodiment (FIG. 5A) is similar to the first embodiment (FIG. 1) with the distinction that the surface of the printed circuit board 140 of the power module 14 is parallel to the plate 1201 of the base 120. Further, the printed circuit board 140 according to the present embodiment may have a circular shape similar to that of the bottom housing 161. The present embodiment may further have a hollow annular insulation sheet 13 disposed between the base 120 and the power module 14. In the embodiment, the power module 14 has a size that is substantially less than the size of the power module 14 of the first embodiment (FIG. 1) or the second embodiment (FIG. 3). As a result, the hollow cylinder 1202 of the present embodiment has a length that is less than the length of the hollow cylinder 1202 of the first embodiment (FIG. 1) or the second embodiment (FIG. 3). FIG. 5B shows a cross-sectional view of the hollow cylinder 1202 with the hollow annular insulation sheet 13 and the printed circuit board 140 according to the third embodiment.

Figure 6:
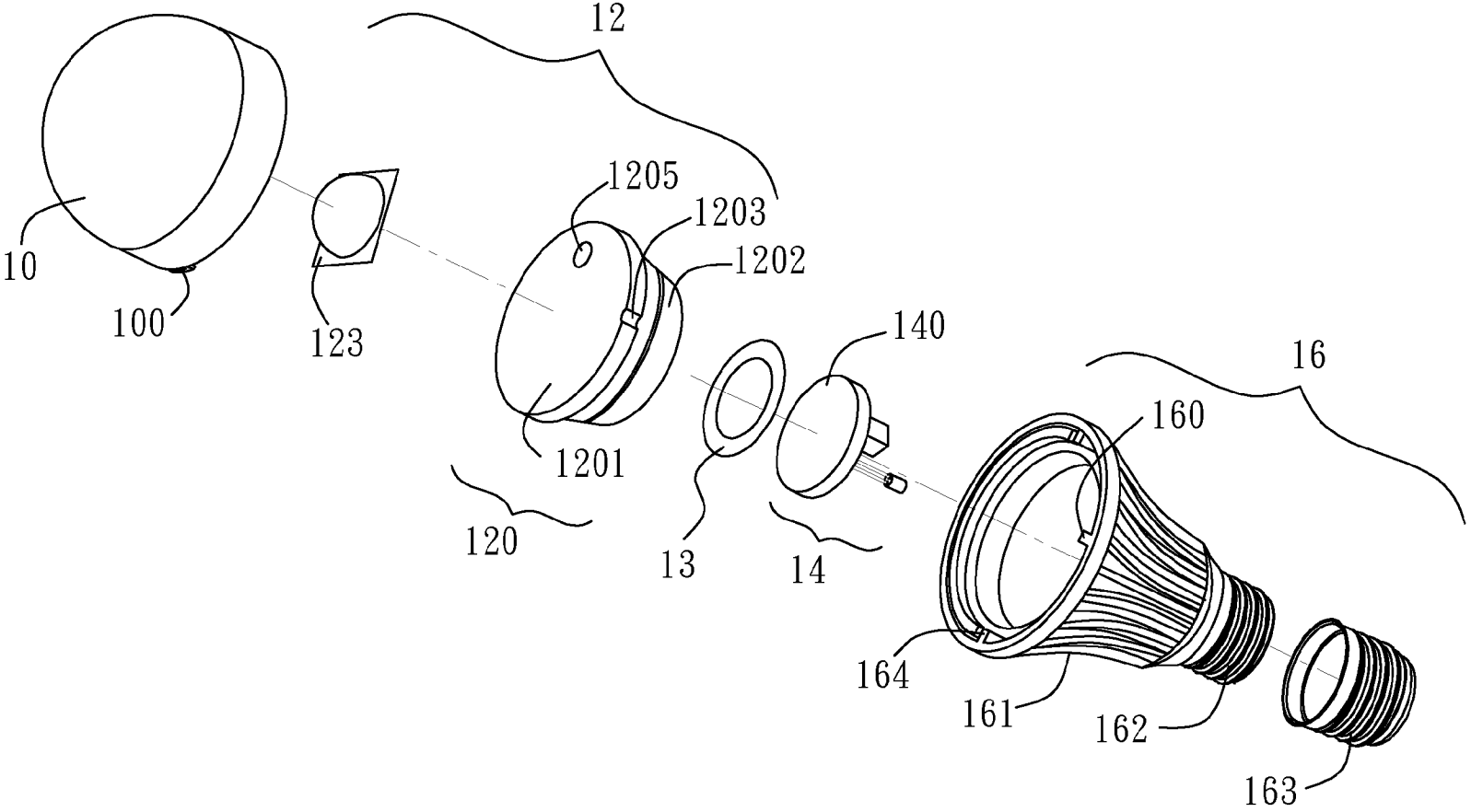
FIG. 6 shows an exploded view of a lighting device according to a fourth embodiment of the present invention.

FIG. 6 shows an exploded view of a lighting device according to a fourth embodiment of the present invention. The present embodiment (FIG. 6) is similar to the third embodiment (FIG. 5A) with the distinction that the lighting module 123 of the present embodiment is directly attached, for example, by soldering, onto the plate 1201 whose surface faces towards the lamp cover 10 (or backwards the housing 16), therefore omitting the heat conductive sheet 121 and the heat conductive substrate 122, and leaving the threaded hole 1204 out of the plate 1201.

Although specific embodiments have been illustrated and described, it will be appreciated by those skilled in the art that various modifications may be made without departing from the scope of the present invention, which is intended to be limited solely by the appended claims.

What is claimed is:

1. A lighting master, comprising: a base defining a space with a housing to accommodate a power module; and a lighting module disposed over the base;

wherein the base comprises a plate and a hollow cylinder extended from a surface of the plate, and the base has an outer surface, the outer surface has at least one step to be bonded with corresponding at least one reverse step on the inner surface of the housing.

2. The lighting master of claim 1, further comprising: a heat conductive substrate;

and a heat conductive sheet disposed between the heat conductive substrate and the plate;

wherein the lighting module is attached on a surface of the heat conductive substrate that faces backwards the housing.

3. The lighting master of claim 1, wherein a power or signal line of the power module is connected to the lighting module via a line outgoing hole of the plate.

4. The lighting master of claim 1, further comprising a printed circuit board embedded in a hollow of the plate, wherein the lighting module is disposed on the printed circuit board whose surface faces backwards the housing, and a control circuit is disposed on the printed circuit board whose surface faces towards the housing.

5. A lighting device, comprising: a housing; a power module; and a lighting master including a base and a lighting module disposed over the base, the base and the housing defining a space to accommodate the power module; wherein the base comprises a plate and a hollow cylinder extended from a surface of the plate, and the base has an outer surface, the outer surface has at least one step to be bonded with corresponding at least one reverse step on the inner surface of the housing.

6. The lighting device of claim 5, wherein the lighting master further comprises:

a heat conductive substrate; and a heat conductive sheet disposed between the heat conductive substrate and the plate; wherein the lighting module is attached on a surface of the heat conductive substrate that faces backwards the housing.

7. The lighting device of claim 5, wherein a power or signal line of the power module is connected to the lighting module via a line outgoing hole of the plate.

8. The lighting device of claim 5, wherein the lighting master further comprises a printed circuit board embedded in a hollow of the plate, wherein the lighting module is disposed on the printed circuit board whose surface faces backwards the housing, and a control circuit is disposed on the printed circuit board whose surface faces towards the housing.

9. The lighting device of claim 5, wherein the housing comprises: a bottom housing; a top housing adjacent to the bottom housing; and a lamp head covering the top housing; wherein the lamp head is screwed into a lamp socket in order to transfer power provided by the lamp socket to an input node of the power module.

10. The lighting device of claim 5, further comprising a lamp cover having at least one inner hook to fasten to corresponding at least one projecting point of the housing.

11. The lighting device of claim 5, wherein the power module comprises a printed circuit board whose surface is perpendicular to the plate.

12. The lighting device of claim 5, wherein the power module comprises a printed circuit board whose surface is parallel to the plate.

13. The lighting device of claim 12, further comprising a hollow annular insulation sheet disposed between the base and the power module.

* * * * *